US008415934B2

(12) United States Patent
Lee

(10) Patent No.: US 8,415,934 B2
(45) Date of Patent: Apr. 9, 2013

(54) AUTOMATIC VOLTAGE REGULATOR

(75) Inventor: Myung Hwan Lee, Seoul (KR)

(73) Assignees: Myung Hwan Lee, Seoul (KR); CSKK (HKG) Limited, Sheung Wan (HK)

( * ) Notice: Subject to any disclaimer, the term of this patent is extended or adjusted under 35 U.S.C. 154(b) by 0 days.

(21) Appl. No.: 12/989,607

(22) PCT Filed: Apr. 7, 2009

(86) PCT No.: PCT/KR2009/001772

§ 371 (c)(1),
(2), (4) Date: Oct. 25, 2010

(87) PCT Pub. No.: WO2009/134016

PCT Pub. Date: Nov. 5, 2009

(65) Prior Publication Data

US 2011/0043182 A1 Feb. 24, 2011

(30) Foreign Application Priority Data

Apr. 30, 2008 (KR) ..... 10-2008-0040180

(51) Int. Cl.
*G05F 1/14* (2006.01)

(52) U.S. Cl. ..... 323/255; 323/247; 307/115

(58) Field of Classification Search ..... 323/247, 323/255–263, 340, 343, 249; 307/31, 115, 307/130.15; 336/150, 200, 192
See application file for complete search history.

(56) References Cited

U.S. PATENT DOCUMENTS

| | | | | |
|---|---|---|---|---|
| 3,700,925 | A * | 10/1972 | Wood | 327/461 |
| 5,808,454 | A * | 9/1998 | Chung | 323/255 |
| 6,100,673 | A * | 8/2000 | Bair et al. | 323/255 |
| 6,417,651 | B1 * | 7/2002 | Kronberg | 323/255 |
| 7,136,724 | B2 * | 11/2006 | Enberg | 700/295 |

FOREIGN PATENT DOCUMENTS

| | | | |
|---|---|---|---|
| KR | 10-1998-033147 | A | 7/1998 |
| KR | 10-1999-028845 | A | 4/1999 |
| KR | 10-2006-0117560 | A | 11/2006 |

OTHER PUBLICATIONS

International Search Report, Appln. No. PCT/KR2009-001772, dated Sep. 29, 2009.

* cited by examiner

*Primary Examiner* — Rajnikant Patel
(74) *Attorney, Agent, or Firm* — Kile Park Reed & Houtteman PLLC

(57) ABSTRACT

The present invention relates to an automatic voltage regulator, and more specifically, to an automatic voltage regulator capable of precisely controlling the output voltage level by using a toroidal autotransformer. The present invention has precise voltage control to enable the output of the voltage level desired by the user, and precisely carries out a variety of applications of power saving and voltage booster. In particular, the present invention can boost/reduce the input voltage to provide a desired target voltage within an error range of 1 volt or less. The present invention also comprises a simple relay switching circuit and excludes semiconductor switching devices, thereby being capable of operating adaptively in different system environments without an additional modification.

11 Claims, 5 Drawing Sheets

AUTOMATIC VOLTAGE REGULATOR

TECHNICAL FIELD

The present invention relates to an automatic voltage regulator, particularly to an automatic voltage regulator capable of precisely controlling an output voltage level by using a toroidal autotransformer.

BACKGROUND

An automatic voltage regulator using a toroidal autotransformer can be implemented using various regulator windings. However, the output voltage of such a regulator is always determined by the winding of its primary and secondary coils. Thus, in order to output various voltages, an automatic voltage regulator using a toroidal autotransformer is designed to wind coils according to the desired voltage or have several output taps.

For example, as illustrated in FIG. 1, an autotransformer can be designed to have a plurality of taps (a, b, c) on a field winding (200) excited in a main winding (100) so as to output various voltage levels. If the toroidal autotransformer is so designed that in case where 220V is applied to the main winding (100), 20V is applied to both ends of the main winding (100) and each tap of the field winding (200) reduces the voltage by 5V, the toroidal autotransformer can supply 200V from the first tap (a), 205V from the second tap (b), and 210V from the third tap (a), to an output terminal.

As such, conventional automatic voltage regulators supply discrete output voltages with a large deviation between the voltages. For example, in the example as described above, each of the output voltages with a deviation of 5V, i.e., each of 200V, 205V and 210V, is selectively supplied. Accordingly, conventional automatic voltage regulators cannot provide precise voltage control.

As such, conventional automatic voltage regulators, providing low precision, are very inconvenient for users. We will explain this in more detail with an example of a power saving device using an automatic voltage regulator providing low precision.

In the case of a high-story apartment, a distribution board is installed in a basement. About 235V is supplied to the first floor, but the supply voltage decrease as the floor gets higher, and as a result, about 205V is supplied to the $15^{th}$ floor. In general, an electronic appliance can operate in a stable manner when a voltage of 205V is supplied. Thus, in case where each house uses a power saving device which decreases the voltage by about 10V, it is not ensured that a house supplied with a voltage of 215V or lower will obtain at least the minimum voltage required for providing stable operation, 205V, due to the use of an inappropriate power saving device. Meanwhile, in the case of the highest floor, it is necessary to increase the voltage level so that a stable voltage can be supplied in a consistent manner.

That is, in the case of a high-story apartment, there is a large deviation in the system voltage provided to a consumer between low floors and high floors. The floors of a high-story apartment are classified into floors where the voltage needs to be reduced to save power and floors where the voltage needs to be increased so that a stable voltage can be supplied. However, conventional automatic voltage regulators are not capable of supplying voltage levels with such a large deviation between them while controlling the voltages precisely, and accordingly users have suffered great inconvenience.

The present invention solves the problems of conventional technology; the present invention provides an automatic voltage regulator capable of precisely controlling the voltage level and thereby of supplying an appropriate voltage.

Meanwhile, in order for a conventional automatic voltage regulator to operate in a power electronic system, complex features such as a main transformer, excitation transformer, detection transformer, highly sensitive effective value detection circuit, high speed A/D transform circuit, triac switching circuit, etc. are required. As a result, conventional automatic voltage regulators have such high prices that they are used in a special case such as an experiment requiring expensive laboratory equipments. Thus, a general user cannot afford such regulators, and thus the conventional regulators do not have marketability.

In addition, because such complex devices cannot operate normally if the frequency and level of a system voltage changes, conventional automatic voltage regulators have to be manufactured in consideration of electricity environment.

In contrast, the automatic voltage regulator of the present invention has a simple structure which does not use a power semiconductor circuit, and thus can control voltage precisely regardless of electricity environment.

Meanwhile, the reason why conventional automatic voltage regulators selectively output discrete output voltage levels with a large deviation between them is because the regulators output an output voltage from a tap fixedly placed on a secondary coil.

The reason for the technical limitation is because a very limited range of winding methods have been used for a toroidal core. In the current process of producing a toroidal core, a main winding is wound on a toroidal core, and then a coil of a certain thickness is wound on the main winding to form field windings where input/output taps are formed. If a non-conductive coil is inserted between the main winding and field windings of a toroidal core, problems occur such as generation of fumes from the inserted coil. Thus, in this process, only field windings serially connected by taps and a main winding are used.

The present invention is to improve such a winding method for conventional toroidal cores and thereby to output various levels of inductive voltages.

SUMMARY

The present invention was conceived to solve said problems of conventional technology. The objective of the present invention is to provide an automatic voltage regulator capable of outputting continuous voltage levels and thereby of controlling voltage precisely.

The above objective of the present invention can be achieved by providing an automatic voltage regulator for converting an input voltage applied to an input terminal and outputting the converted input voltage to an output terminal according to the present invention, comprising: a main winding unit having one end thereof connected to the input terminal and the other end thereof connected to the output terminal, and having a plurality of main windings and a plurality of first switches for switching so that the plurality of main windings are selectively serially connected; a field winding excited in at least one of the main windings connected serially by the first switches of the main winding unit; a second switch for selectively connecting one end of the field winding to either a reference potential or the output terminal; a third switch for connecting the other end of the field winding to either the reference potential or the input terminal; and a control unit which regulates the level of an output voltage output to the output terminal by switching control of the plurality of first switches, the second switch, and the third switch.

In addition, said automatic voltage regulator of the present invention further comprises a level measurement unit for measuring the level of the input voltage inputted to the input terminal, and wherein the control unit is configured to be able to: if a predetermined target voltage is higher than the level of the input voltage measured by the level measurement unit, switch control the plurality of first switches in response to a voltage difference between the predetermined target voltage and the measured level of the input voltage, control the second switch to connect the one end of the field winding to the reference potential, and control the third switch to connect the other end of the field winding to the input terminal, and if the predetermined target voltage is lower than the level of the input voltage, switch control the plurality of first switches in response to the difference between the predetermined target voltage and the measured level of the input voltage, control the second switch to connect the one end of the field winding to the output terminal, and control the third switch to connect the other end of the field winding to the reference potential.

In addition, said automatic voltage regulator of the present invention may further comprise a user input unit for inputting the predetermined target voltage from the user. In addition, preferably, said automatic voltage regulator of the present invention further comprises a bypass path for causing the input voltage to bypass the main winding unit; and a bypass switch for switching a connection condition for the bypass path, and wherein if the level of the input voltage corresponds to the predetermined target voltage, the automatic voltage regulator is configured to turn on the bypass switch to cause the input voltage to bypass the main winding unit.

In addition, according to the present invention, the field winding is wound on a toroidal core, the plurality of main windings wind the field winding, and the plurality of main windings are wound on the toroidal core so as not to overlap.

The objective of the present invention can be achieved by another embodiment of the present invention, an automatic voltage regulator for converting an input voltage inputted to an input terminal to output the converted input voltage to an output terminal, comprising: a main winding unit having one end thereof connected to the input terminal and the other end thereof connected to the output terminal, and having a plurality of main windings and a plurality of first switches for switching so that the plurality of main windings are selectively serially connected; a field winding excited in at least one of the main windings connected serially by the first switches of the main winding unit; and a control unit which regulates the level of an output voltage output to the output terminal by switching control of the plurality of first switches, the second switch, and the third switch.

The automatic voltage regulator further comprises a level measurement unit for measuring the level of an input voltage inputted to the input terminal, and if the predetermined target voltage is lower than the level of the input voltage, the control unit switch controls the plurality of first switches in response to a voltage difference between the target voltage and the measured level of the input voltage.

In addition, the automatic voltage regulator of the present invention further comprises a bypass path to cause the input voltage to bypass the main winding unit; and a bypass switch for switching a connection condition for the bypass path, and if the level of the input voltage corresponds to the predetermined target voltage, the automatic voltage regulator is configured to turn on the bypass switch to cause the input voltage to bypass the main winding unit.

DETAILED DESCRIPTION

The embodiments of the present invention are explained in detail with reference to the accompanying drawings.

Figure 1:
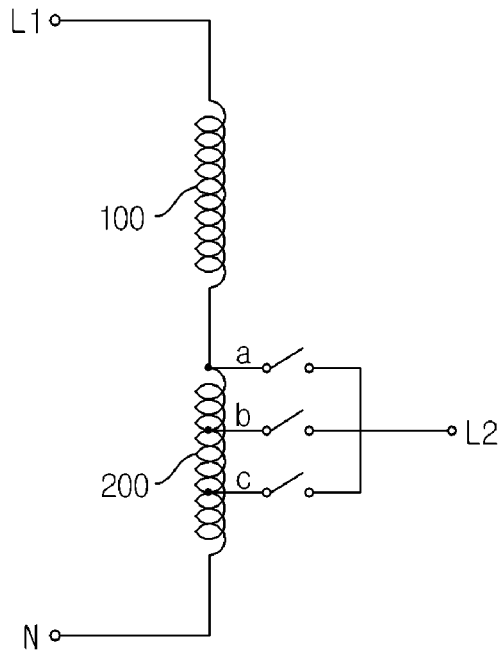
FIG. 1 is a schematic drawing of the circuit for explaining that in conventional toroidal transformers, a plurality of voltage levels are output from a plurality of tabs of the field winding.
Figure 2:
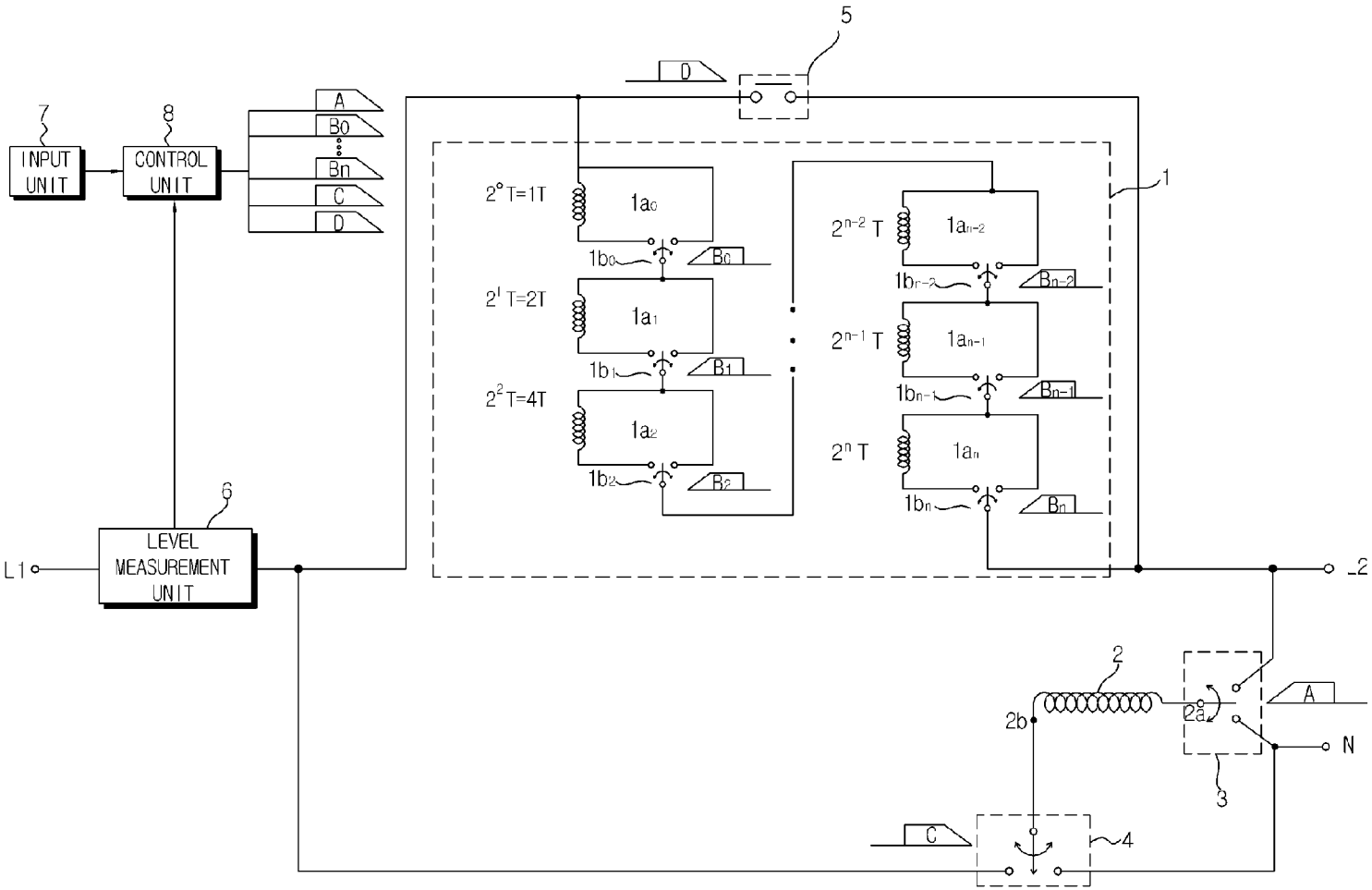
FIG. 2 is a schematic drawing of the internal structure of the automatic voltage regulator capable of regulating the output voltage to the voltage corresponding to 1[turn] according to the first embodiment of the present invention.

FIG. 2 is a schematic drawing of the internal structure of the automatic voltage regulator according to the first embodiment of the present invention.

Referring to FIG. 2, the automatic voltage regulator is configured to comprise a main winding unit (1) having a plurality of main windings ($\mathbf{1}a_0$~$\mathbf{1}a_n$) and a plurality of first switches ($\mathbf{1}b_0$~$\mathbf{1}b_n$), a field winding (2), a second switch (3), a third switch (4), a bypass switch (5), a level measurement unit (6), an input unit (7) and a control unit (8).

The main winding unit (1) has one end connected to an input terminal (L1) to which an input voltage applies and the other end connected to an output terminal (L2). The circuit connection between both ends (connection among the main windings ($\mathbf{1}a_0$~$\mathbf{1}a_n$)) is determined according to how the plurality of first switches ($\mathbf{1}b_0$~$\mathbf{1}b_n$) are switch connected. That is, as illustrated, depending on whether the first switches ($\mathbf{1}b_0$~$\mathbf{1}b_n$) are connected to one end of the main windings ($\mathbf{1}a_0$~$\mathbf{1}a_n$), it is determined whether the corresponding main windings ($\mathbf{1}a_0$~$\mathbf{1}a_n$) are comprised as one element of a serial circuit connecting both ends of the main winding unit (1). Hereinafter, it is referred to as a "serial mode" where the first switches ($\mathbf{1}b_0$~$\mathbf{1}b_n$) are connected to one end of the main windings ($\mathbf{1}a_0$~$\mathbf{1}a_n$) so that the main windings ($\mathbf{1}a_0$~$\mathbf{1}a_n$) become one part of the serial circuit to increase the total number of main windings, whereas it is referred to as an "insulating mode" where the main windings ($\mathbf{1}a_0$~$\mathbf{1}a_n$) are insulated from the serial circuit.

By switching control of the plurality of first switches ($\mathbf{1}b_0$~$\mathbf{1}b_n$) in the serial mode or insulating mode individually, the main windings ($\mathbf{1}a_0$~$\mathbf{1}a_n$) comprised in the serial circuit which connects both ends of the main winding unit (1) can be selected, and thereby the total number of main windings comprised in the serial circuit can be controlled.

In particular, in the present embodiment, the plurality of main windings ($\mathbf{1}a_0$~$\mathbf{1}a_n$) are formed to have turns of $2^0=1$, $2^1=2$, $2^2=4$, $2^3=8$, . . . , $2^n$T(turns) (here, n is a natural number). Thus, by combining the main windings ($\mathbf{1}a_0$~$\mathbf{1}a_n$) to form a serial circuit, the total number of main windings of the serial circuit between both ends of the main winding unit (1) can be regulated so as to correspond to a natural number within expressible range. For example, if n is 10, the number of main windings can be regulated to have turns corresponding to any natural number between 1~2047.

The field winding (2) is excited in the main windings ($\mathbf{1}a_0$~$\mathbf{1}a_n$) serially connected between both ends of the main winding unit (1). Therefore, the turns of the field winding (2)

are fixed, but the level of voltage at which to excite the field winding (2) varies depending on the total number of main windings comprised in the serial circuit of the main winding unit (1).

The second switch (3) is designed to selectively connect one end (2*a*) of the field winding (2) to either a reference potential (N) or the output terminal (L2), and in this connection, the third switch (4) is designed to selectively connect the other end (2*b*) of the field winding (2) to either the reference potential (N) or the input terminal (L1).

To be specific, if the second switch (3) is switched to connect one end (2*a*) of the field winding (2) to the output terminal (L2), the third switch (4) is inevitably switched to connect the other end (2*b*) of the field winding (2) to the reference potential (N). In contrast, if the second switch (3) is switched to connect one end (2*a*) of the field winding (2) to the reference potential (N), the third switch (4) is inevitably switched to connect the other end (2*b*) of the field winding (2) to the input terminal (L1).

This is for conversion between a mode where an inductive voltage formed in the field winding (2) is added to the input voltage (hereinafter, "addition mode") and a mode where the inductive voltage is subtracted from the input voltage (hereinafter, "subtraction mode"). In the following description, details are given to explain which mode is used under which condition. Here, details are given to explain that the second switch (3) and the third switch (4) are interlocked in a certain way and switched for conversion between these modes.

In the present experimental example, an embodiment is explained where the winding direction of the field winding (2) and main windings ($\mathbf{1}a_0$~$\mathbf{1}a_n$) are uniformly fixed to a toroidal core, and particularly, if one end (2*a*) of the field winding (2) is connected to the output terminal (L2) and the other end is connected to the reference potential (N), the field winding (2) and the main windings ($\mathbf{1}a_0$~$\mathbf{1}a_n$) are wound to operate in subtraction mode.

Referring to FIG. 2 again, the bypass switch (5) is configured to directly connect the input terminal (L1) to the output terminal (L2) or insulate the input terminal (L1) from the output terminal (L2), and provides a path for bypassing for the input voltage when a user attempts to output the input voltage without change.

The level measurement unit (6) is configured to measure the level of voltage inputted through the input terminal (L1), and a peak value, or an rms value, is measured and output.

The input unit (7) is configured to receive a target voltage from a user that the user attempts to output, and is variously implemented as a panel where an input switch such as an up-down key is formed, a receiving device for receiving a remote control instruction, etc. The target voltage may be a value stored as default or previously inputted by the user, or a value newly revised during operation.

The control unit (8) compares the input voltage measured at the level measurement unit (6) and the target voltage, and performs switching control operation of the first~third switches ($\mathbf{1}b_0$~$\mathbf{1}b_n$, 3, 4) and bypass switch (5) to adjust the input voltage to the target voltage.

Focusing on the operation of the control unit (8), the overall operation of the automatic voltage regulator illustrated in FIG. 2. will be explained according to the target voltage and the input voltage.

For better understanding, experimental data as shown in below <Table 1> will be referred to. <Table 1> shows experimental data showing how the total turns of the main winding unit (1) are determined as the input voltage is inputted between 187V and 220V under the condition where the turns of the field winding (2) are fixed at 500 T and the target voltage is set to 220V.

TABLE 1

| Target voltage | Input voltage | Voltage difference | Number of main windings to be required | Voltage regulation |
|---|---|---|---|---|
| 220 V | 220 | 0 | Bypass | ±0.0% |
| | 219 | 1 | 2 | ±0.5% |
| | 218 | 2 | 5 | ±0.9% |
| | 217 | 3 | 7 | ±1.4% |
| | 216 | 4 | 9 | ±1.8% |
| | 215 | 5 | 12 | ±2.3% |
| | 214 | 6 | 14 | ±2.7% |
| | 213 | 7 | 16 | ±3.2% |
| | 212 | 8 | 19 | ±3.6% |
| | 211 | 9 | 21 | ±4.1% |
| | 210 | 10 | 24 | ±4.5% |
| | 209 | 11 | 26 | ±5.0% |
| | 198 | 22 | 37 | ±10.0% |
| | 187 | 33 | 88 | ±15.0% |

i) If the target voltage (220V) is identical to the input voltage (220V)—bypass mode:

The input voltage is controlled to be output without change. To this end, the control unit (8) turns on the bypass switch unit (5) to cause the input voltage to bypass the main winding unit (1) and be output to the output terminal (L2). (Refer to the first line of Table 1)

ii) If the target voltage (220V) is higher than the input voltage—addition mode:

The input voltage must be boosted to the target voltage.

To this end, the control unit (8) controls the first~third switches and bypass switch (5) to cause the input voltage to be boosted for output.

To be specific, the control unit (8) turns off the bypass switch (5), controls the second switch (3) to connect one end (2*a*) of the field winding (2) to the reference potential (N), and controls the third switch (4) to connect the other end (2*b*) of the field winding (2) to the input terminal (L1) (addition mode).

Meanwhile, the control unit (8) regulates the level of the inductive voltage of the field winding (2) which is the size of added voltage so as to compensate the difference between the level of the input voltage measured at the level measurement unit (6) and the target voltage. To achieve this, the control unit (8) calculates the total turns of the main winding unit (1) that can induce the voltage corresponding to the voltage difference, and controls the first switches ($\mathbf{1}b_0$~$\mathbf{1}b_n$) so that the main windings ($\mathbf{1}a_0$~$\mathbf{1}a_n$) to be combined according to the calculation form a serial circuit. That is, the control unit (8) selectively switch controls the corresponding first switches ($\mathbf{1}b_0$~$\mathbf{1}b_n$) to the serial mode or insulating mode so that the combination of main windings corresponds to the total calculated turns.

Referring to <Table 1>, it can be confirmed that as the input voltage gets lower than the target voltage 220V and the voltage difference increases, the turns of the overall main winding unit (1), i.e., the sum of the turns of the main windings ($\mathbf{1}a_0$~$\mathbf{1}a_n$) serially connected, should increase to increase the level of voltage induced to the field winding (2) and thus make voltage compensation possible. For example, in case the input voltage is 219 V, the voltage difference is 1V and the number of main windings to be required is 2T, whereas in case the input voltage is 210V, the voltage difference is 10V and the number of main windings to be required is 24 T.

iii) If the target voltage is lower than the input voltage—subtraction mode:

The control unit (8) controls the first~third switches and bypass switch (5) to cause the input voltage to be subtracted for output.

To be specific, the control unit (8) turns off the bypass switch (5), controls the second switch (3) to connect one end (2*a*) of the field winding (2) to the output terminal (L2), and controls the third switch (4) to connect the other end (2*b*) of the field winding (2) to the reference potential (N).

Meanwhile, the control unit (8) regulates the level of the inductive voltage of the field winding (2), which is the size of subtracted voltage, so as to compensate the difference between the level of the input voltage measured at the level measurement unit (6) and the target voltage. To achieve this, the control unit (8) calculates the total turns of the main winding unit (1) that can induce the voltage corresponding to the voltage difference, and controls the first switches ($\mathbf{1}b_0$~$\mathbf{1}b_n$) so that the main windings ($\mathbf{1}a_0$~$\mathbf{1}a_n$) to be combined according to the calculation form a serial circuit. That is, the control unit (8) selectively switch controls the corresponding first switches ($\mathbf{1}b_0$~$\mathbf{1}b_n$) in the serial mode or insulating mode so that the combination of main windings corresponds to the total calculated turns.

Referring to <Table 1> again, it can be understood that the number of main windings to be required is proportional to the absolute value of the difference between the target voltage and the input voltage. Therefore, whether the input voltage is higher or lower than the target voltage merely relates to the switching mode of the second switch (3) and the third switch (4), but is not a factor that modifies the number of main windings to be required.

Comparing 'voltage difference,' 'voltage regulation' and 'number of main windings to be required' among the columns at <Table 1>, it can be understood that they are proportional to one another. That is, as the voltage difference is greater, the voltage level to be compensated is greater. Thus, it can be understood that the total number of main windings should be controlled to increase in order to increase the inductive voltage of the field winding (2).

In addition, <Table 1> shows that the voltage difference of less than 1V as well as the difference of 1V unit can be compensated, and it may vary depending on the turns and core capacity of the field winding (2). Therefore, the control unit (8) stores data on the voltage difference and the number of main windings to be required according to specifications in advance, and based on the stored data, the control unit (8) can selectively switch control the first switches ($\mathbf{1}b_0$~$\mathbf{1}b_n$) to serial mode or insulating mode.

The constitution of FIG. 2 according to the first embodiment of the present invention can be understood to be variously modified within the scope of the present invention.

For example, it can be understood that for the turns of the main windings ($\mathbf{1}a_0$~$\mathbf{1}a_n$), other combinations can be possible instead of $2^k$ (k=0, 1, 2, 3, . . . ). For example, once the turns and core capacity of the field winding (2) are determined, it is possible to decide on the number of the turns of the main windings ($\mathbf{1}a_0$~$\mathbf{1}a_n$) so as to correspond to the voltage difference of $2^j$[V] (j=0, 1, 2, 3 . . . ). In this case, it is difficult to regulate the voltage of less than 1V, but it is possible to compensate the voltage difference of 1V unit.

Further, it can be understood that the turns of the field winding (2) may not be fixed. In this case, it is necessary to properly select the number of turns for the main windings and field windings, which may be experimentally determined in advance.

According to other embodiments of the present invention, in case the number of turns of the main windings is not determined in advance according to the voltage difference, it is possible to increase or decrease the turns serially connected after measuring the level of the output voltage and evaluating the measured value to find the appropriate turns.

As explained above, under the environment of poor electric power supply where the input voltage does not reach the rated voltage of electric appliance as well as under the environment where power saving is required, the automatic voltage regulator of the present invention can provide rated voltage by automatically boosting input voltage.

The present invention can selectively boost or reduce the output voltage by switching the second switch (3) and the third switch (4), and greatly improve the extent of boosting and reducing by switching the first switches ($\mathbf{1}b_0$~$\mathbf{1}b_n$).

Figure 3:
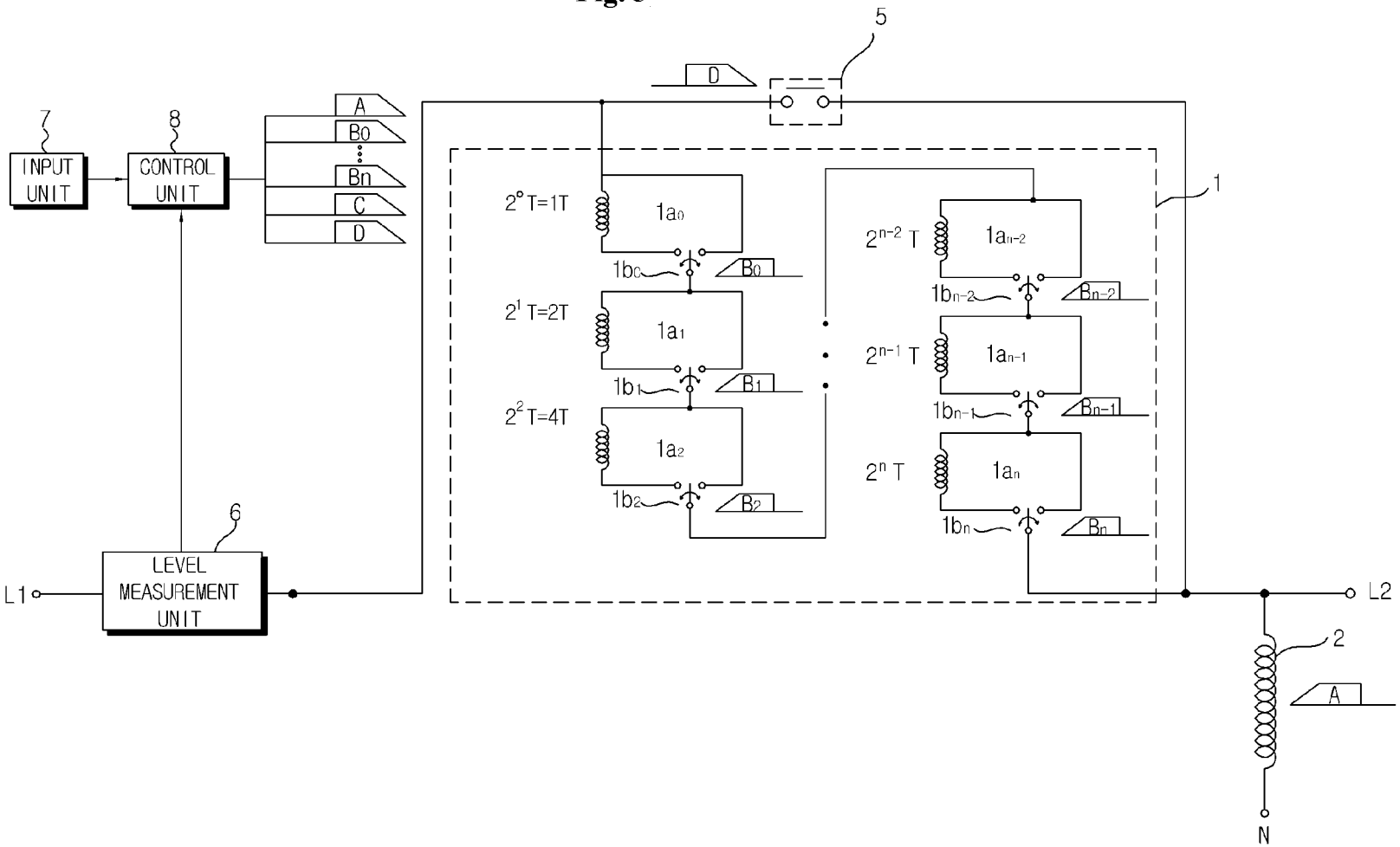
FIG. 3 is a schematic drawing of the internal structure of the automatic voltage regulator according to the second embodiment of the present invention.

FIG. 3 is a schematic drawing of the circuit of the automatic voltage regulator according to the second embodiment of the present invention, which is almost the same internal structure as in FIG. 2. Thus, focusing on the differences in the structural characteristics between FIG. 3, and FIG. 2 and the first embodiment, a second embodiment will be explained.

Referring to FIG. 3, one end of the field winding is fixedly connected to the output terminal, and the other end is fixedly connected to the reference potential.

Therefore, as mentioned in relation to the first embodiment, the automatic voltage regulator of FIG. 3 is used only for reducing the input voltage or allowing it a bypass, but cannot be used for boosting the input voltage.

Said limitation on usage results from consideration of actual industrial usage, such as consumers' demands for saving power, infrastructure where electric power supply is stable, etc.

Although options on the mode of operation are limited compared to those of the first embodiment, the automatic voltage regulator of the second embodiment is the same as that of the first embodiment, in that it is capable of operation in the aforementioned subtraction mode and precise control down to 1 [V].

Figure 4:
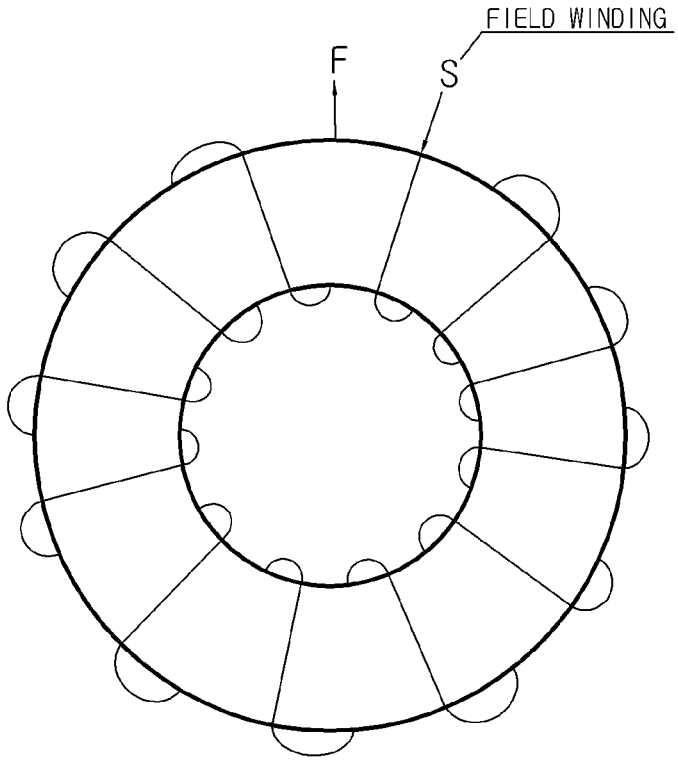
FIG. 4 and FIG. 5 are schematic drawings for explaining the winding method of the toroidal transformer used in the embodiments of the present invention.
Figure 5:
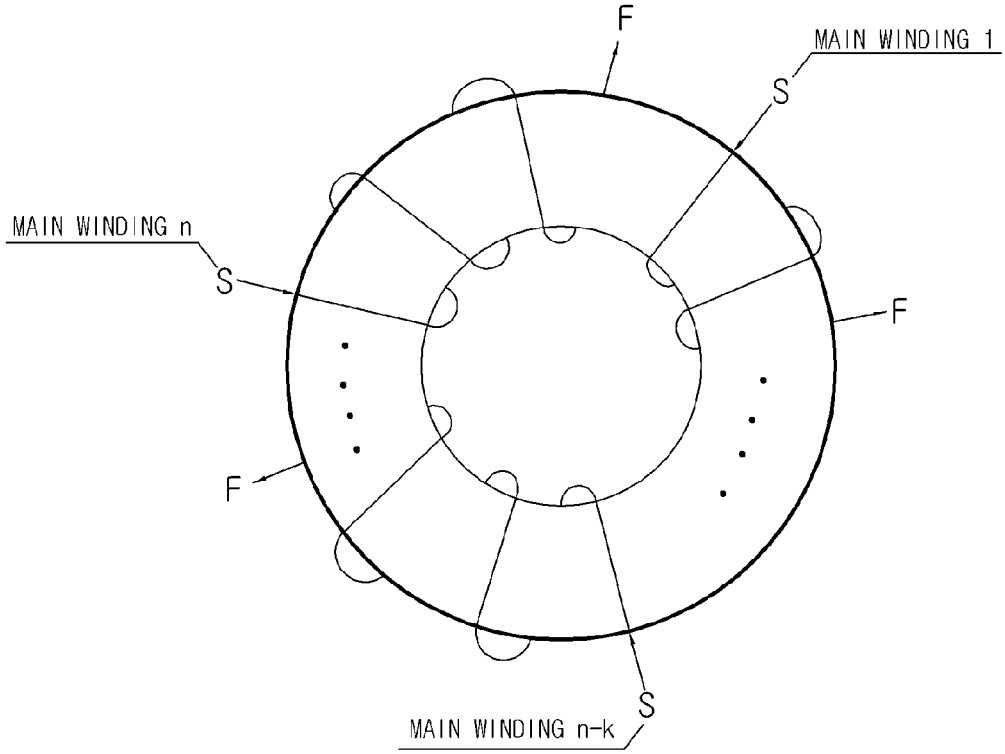

FIG. 4 and FIG. 5 are schematic diagrams for explaining the windings of a toroidal transformer according to the first and second embodiments of the present invention.

Referring to FIG. 4, the field winding (2) is wound so as to be distributed all over a toroidal core first. Next, as illustrated in FIG. 5, a plurality of main windings ($\mathbf{1}a_0$~$\mathbf{1}a_n$) are wound on the field winding (2), i.e., coils are wound to cover the field winding (2) so as not to overlap. Each of the main windings ($\mathbf{1}a_0$~$\mathbf{1}a_n$) is configured to have a starting point and terminating point of the winding, and the plurality of main windings ($\mathbf{1}a_0$~$\mathbf{1}a_n$) are counted and distinguished by the unit consisting of the starting point and terminating point.

As explained above, conventional toroidal transformers were configured to remove a tab so as to be capable of obtaining different levels of inductive voltage, with the field winding (2) wound on the main windings ($\mathbf{1}a_0$~$\mathbf{1}a_n$), and thereby, the degree of boosting and reducing of voltage is fixed and extremely limited.

In contrast, in the toroidal transformer according to the present invention, the main windings ($\mathbf{1}a_0$~$\mathbf{1}a_n$) are distributed and wound on the field winding (2) so as not to overlap, and thus it can obtain various levels of output voltage, which provides a wide choice of selections compared to conventional toroidal transformers.

As described above, the present invention has precise voltage control to enable the output of the voltage level desired by the user, and precisely carries out a variety of applications of power saving and voltage booster. In particular, the present invention can boost/reduce the input voltage to provide a desired target voltage within an error range of 1 volt or less.

Also, the present invention comprises a simple relay switching circuit and excludes semiconductor switching devices, thereby being capable of operating adaptively in different system environments without an additional modification.

Further, the present invention does not form many output tabs or auxiliary coils, and can regulate the voltage in a broader range, and at the same time can accurately output any values within the voltage regulation band.

In addition to the embodiments illustrated and described above, a person having ordinary knowledge in the art to which the present invention pertains can understand that various modifications of the present embodiments can be practiced without deviating the technological spirit or principle of the present invention.

For example, the first switch of the present invention is to flexibly determine the turns of the main windings serially connected within a circuit, and thus can be placed at different positions unlike from the positions in FIG. 2 and FIG. 3. To be specific, even if a plurality of tabs are placed on the main windings, and any one of these tabs is connected to either the input terminal or output terminal, the winding of the main windings can be selectively modified.

Therefore, the present invention must be interpreted to include all cases where the first switch is arranged to determine the final turns of the main windings, and such modifications must be understood to be within the scope of the present invention.

The scope of invention will be determined by the accompanying claims and their equivalents.

INDUSTRIAL APPLICABILITY

The present invention can be usefully applied to all electronic equipment requiring a stable voltage.

What is claimed is:

1. An automatic voltage regulator for converting an input voltage applied to an input terminal and outputting the converted input voltage to an output terminal, comprising:

a main winding unit having one end thereof connected to the input terminal and the other end thereof connected to the output terminal, and having a plurality of main windings and a plurality of first switches for switching so that the plurality of main windings are selectively serially connected;

a field winding excited in at least one of the main windings connected serially by the first switches of the main winding unit;

a second switch for selectively connecting one end of the field winding to either a reference potential or the output terminal;

a third switch for connecting the other end of the field winding to either the reference potential or the input terminal; and a control unit which regulates the level of an output voltage output to the output terminal by switching control of the plurality of first switches, the second switch, and the third switch.

2. The automatic voltage regulator of claim 1, further comprising a level measurement unit for measuring the level of the input voltage inputted to the input terminal, and wherein the control unit is configured to:

if a predetermined target voltage is higher than the level of the input voltage measured by the level measurement unit, switch control the plurality of first switches in response to a voltage difference between the predetermined target voltage and the measured level of the input voltage, control the second switch to connect the one end of the field winding to the reference potential, and control the third switch to connect the other end of the field winding to the input terminal, and if the predetermined target voltage is lower than the level of the input voltage, switch control the plurality of first switches in response to the difference between the predetermined target voltage and the measured level of the input voltage, control the second switch to connect the one end of the field winding to the output terminal, and control the third switch to connect the other end of the field winding to the reference potential.

3. The automatic voltage regulator of claim 2, further comprising a user input unit for inputting the predetermined target voltage from the user.

4. The automatic voltage regulator of claim 2, further comprising:

a bypass path for causing the input voltage to bypass the main winding unit; and a bypass switch for switching a connection condition for the bypass path, and wherein if the level of the input voltage corresponds to the predetermined target voltage, the automatic voltage regulator is configured to turn on the bypass switch to cause the input voltage to bypass the main winding unit.

5. The automatic voltage regulator of claim 1, wherein the field winding is wound on a toroidal core, the plurality of main windings wind the field winding, and the plurality of main windings are wound on the toroidal core so as not to overlap with the field winding.

6. An automatic voltage regulator for converting an input voltage inputted to an input terminal to output the converted input voltage to an output terminal, comprising:

a main winding unit having one end thereof connected to the input terminal and the other end thereof connected to the output terminal, and having a plurality of main windings and a plurality of first switches for switching so that the plurality of main windings are selectively serially connected;

a field winding excited in at least one of the main windings connected serially by the first switches of the main winding unit; and a control unit which regulates the level of an output voltage output to the output terminal by switching control of the plurality of first switches, the second switch, and the third switch.

7. The automatic voltage regulator of claim 6, further comprising a level measurement unit for measuring the level of the input voltage inputted to the input terminal, and wherein the control unit is configured to:

if a predetermined target voltage is lower than the level of the input voltage, switch control the plurality of first switches in response to the difference between the predetermined target voltage and the measured level of the input voltage.

8. The automatic voltage regulator of claim 7, further comprising:

a bypass path for causing the input voltage to bypass the main winding unit; and a bypass switch for switching a connection condition for the bypass path, and wherein if the level of the input voltage corresponds to the predetermined target voltage, the automatic voltage regulator is configured to turn on the bypass switch to cause the input voltage to bypass the main winding unit.

9. The automatic voltage regulator of claim 6, wherein the field winding is wound on a toroidal core, the plurality of main windings wind the field winding, and the plurality of main windings are wound on the toroidal core so as not to overlap.

10. The automatic voltage regulator of claim 2, wherein the field winding is wound on a toroidal core, the plurality of main windings wind the field winding, and the plurality of main windings are wound on the toroidal core so as not to overlap with the field winding.

11. The automatic voltage regulator of claim 7, wherein the field winding is wound on a toroidal core, the plurality of main windings wind the field winding, and the plurality of main windings are wound on the toroidal core so as not to overlap.

* * * * *